US008726916B2

(12) United States Patent
Park

(10) Patent No.: US 8,726,916 B2
(45) Date of Patent: May 20, 2014

(54) INTERCHANGEABLE MAKEUP BRUSH

(75) Inventor: Hyun-Jin Park, Daejeon (KR)

(73) Assignee: Hyun-Jin Park (KR)

( * ) Notice: Subject to any disclaimer, the term of this patent is extended or adjusted under 35 U.S.C. 154(b) by 0 days.

(21) Appl. No.: 13/547,309

(22) Filed: Jul. 12, 2012

(65) Prior Publication Data

US 2013/0014338 A1 Jan. 17, 2013

(30) Foreign Application Priority Data

Jul. 15, 2011 (KR) ..... 10-2011-0070485

(51) Int. Cl.
*A45D 44/18* (2006.01)
*A45D 40/26* (2006.01)

(52) U.S. Cl.
USPC ..... 132/313; 132/320

(58) Field of Classification Search
USPC ..... 132/313, 317, 318, 320, 218, 310; 206/581, 823, 235; 15/176.1, 176.6
See application file for complete search history.

(56) References Cited

U.S. PATENT DOCUMENTS

| | | | | |
|---|---|---|---|---|
| 2,913,750 | A * | 11/1959 | Aversa | 15/184 |
| 7,386,910 | B2 * | 6/2008 | Minkler et al. | 15/145 |
| 2010/0095973 | A1 * | 4/2010 | Shrier et al. | 132/200 |

* cited by examiner

*Primary Examiner* — Rachel Steitz
(74) *Attorney, Agent, or Firm* — Kaplan Breyer Schwarz & Ottesen, LLP

(57) ABSTRACT

Provided is an interchangeable makeup brush including: a plurality of brush tips fixing a brush; and a brush rod having the brush tip detachably coupled thereto, and being grasped by a hand of a user, wherein the brush tip includes a mounting protruding portion formed at a rear thereof which is inserted and coupled in the brush rod. According to the present invention, a brush tip may be attached and detached to and from a brush rod, enabling convenient use when applying makeup by selecting and mounting a required brush, and allowing only one brush rod to be provided for economical advantage and ease of portability and storage.

3 Claims, 6 Drawing Sheets

INTERCHANGEABLE MAKEUP BRUSH

CROSS-REFERENCE TO RELATED APPLICATIONS

Korean patent application KR 10-2011-0070485, filed Jul. 15, 2011, is incorporated herein by reference.

BACKGROUND OF THE INVENTION

1. Field of the Invention

The present invention relates to an interchangeable makeup brush, and more particularly, to an interchangeable makeup brush configured in a structure capable of being interchanged on a brush rod so as to allow a required brush to be attached and conveniently used when applying makeup.

2. Description of the Related Art

In general, a makeup brush is used to apply cosmetics in powder form, and is configured of a brush formed of a plurality of hairs, a brush tip for fixing the brush, and a brush rod fixing the brush tip and having a suitable length and thickness so as to be grasped by a user's hand.

In a makeup brush, the brush is fixed through the brush tip, and the brush tip is integrally formed with the brush rod so that manufacturing is made easy through one manufacturing process. However, when the brush hairs fall out or the brush is used for an extended period of time so that the hairs bend or become worn, the function of the brush is reduced, whereupon the entire makeup brush must be discarded. Thus, because usable portions cannot be reused, resources are wasted.

Also, because the brush, the brush tip, and the brush rod are integrally formed, different brushes must be used for performing different functions of makeup, which requires not only the brush, but also a makeup brush configured of not only the brush, but also the brush tip and the brush rod for the brush. Therefore, a user must possess a separate makeup brush suitable for the characteristics of cosmetics used, which imposes a financial burden.

SUMMARY OF THE INVENTION

Accordingly, the present invention is directed to an interchangeable makeup brush that substantially obviates one or more problems due to limitations and disadvantages of the related art, by having the brush tip and the brush rod configured separately, and being configured in a structure in which many types of brush tips may be selected and attached and detached to and from the brush rod, so that a required brush may be attached when applying makeup for convenient use.

To achieve the above objects, the present invention provides an interchangeable makeup brush including: a plurality of brush tips fixing a brush; and a brush rod having the brush tip detachably coupled thereto, and being grasped by a hand of a user, wherein the brush tip includes a mounting protruding portion formed at a rear thereof which is inserted and coupled in the brush rod.

The brush rod may include: a housing having a first open portion and a second open portion respectively formed on a top and bottom thereof, and a stopper portion formed thereon and having a through-hole formed along an inner peripheral surface thereof; a push member inserted and coupled to be capable of sliding movement within the housing, and having a bottom portion thereof partially exposed to an outside of the housing through the second open portion; a spring inserted in the housing, and having one end thereof supported on the stopper portion and the other end thereof supported on the push member to resiliently support the push member; a holder inserted and fixed in a top of the push member, and having a finger portion formed cut at an upper portion thereof, for selectively clamping (holding) the mounting protruding portion of the brush tip; and a cap coupled to the first open portion.

When a pressing portion of the push member is exposed to the outside of the housing by the spring, the finger portion of the holder may clamp the mounting protruding portion of the brush tip to mount the brush tip to the brush rod, and when a user overcomes a resilient force of the spring and presses the pressing portion of the push member, the finger portion of the holder may unclamp the mounting protruding portion of the brush tip to separate the brush tip from the brush rod.

The push member may include a fixing ledge formed on an upper portion thereof, and a lower portion of the holder may be fixed on the fixing ledge.

The finger portion of the holder may be converged when pressed by the stopper portion, and may diverge when released by the stopper portion.

A catching ledge may be formed on the lower, inner surface of the housing to restrict the position of the push member, and a catch protrusion may be formed on the outer peripheral surface of the push member to correspond to the catching ledge.

As described above, the present invention is configured in a structure in which a brush tip may be attached and detached to and from a brush rod, enabling convenience of use by attaching a required brush when applying cosmetics. Thus, only one brush rod is needed, which is economically beneficial, and allows for easy portability and storage.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an interchangeable makeup brush according to the present invention will be described in detail, with reference to the attached drawings.

Figure 1A:
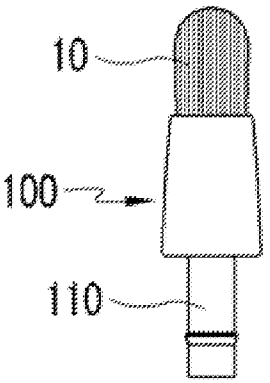
FIG. 1 is a drawing illustrating brush tips for an interchangeable makeup brush according to the present invention.
Figure 1B:
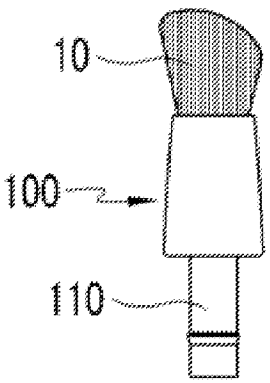
Figure 1C:
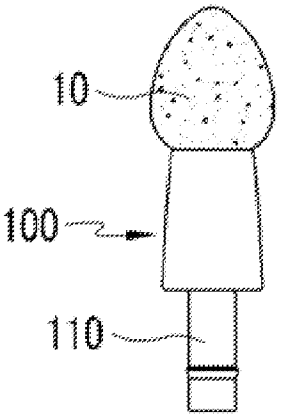
Figure 1D:
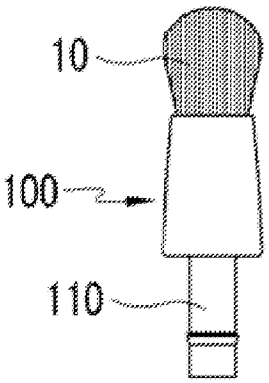
Figure 1E:
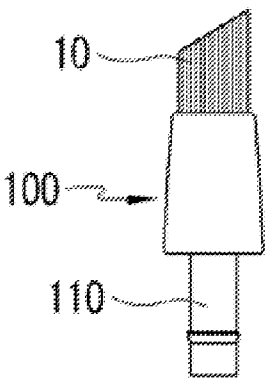
Figure 1F:
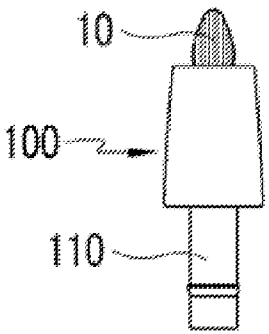
Figure 1G:
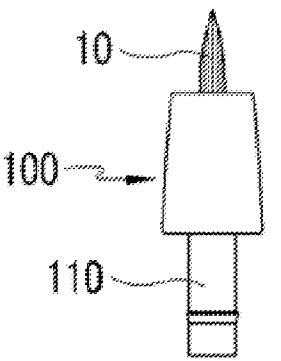
Figure 1H:
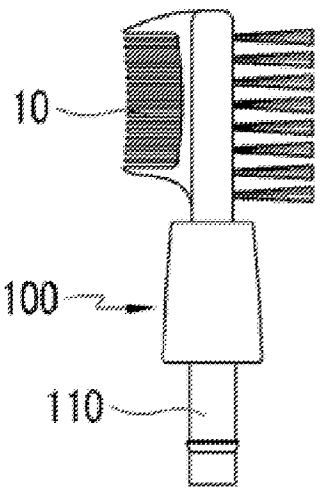
Figure 2:
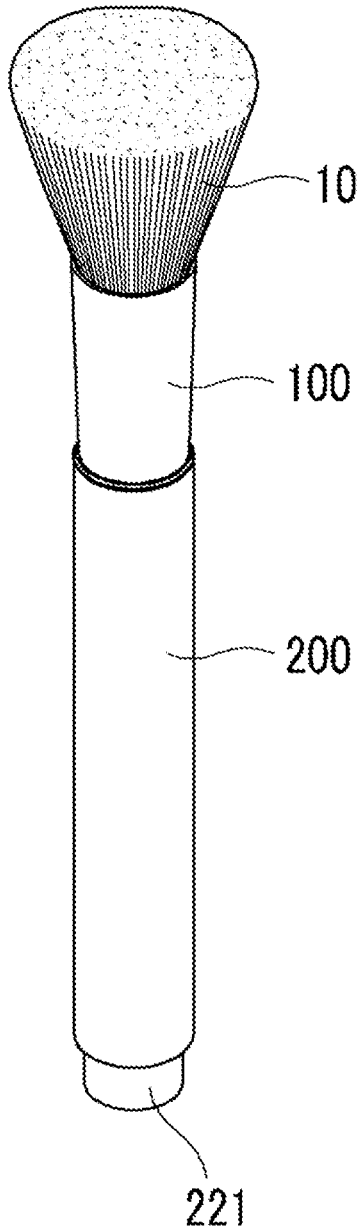
FIG. 2 is a perspective view illustrating an interchangeable makeup brush according to the present invention.
Figure 3:
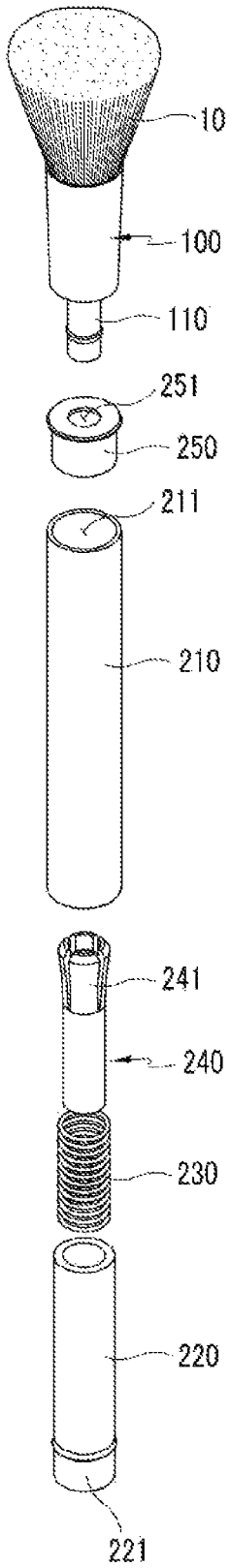
FIG. 3 is an exploded perspective view illustrating an interchangeable makeup brush according to the present invention.
Figure 4:
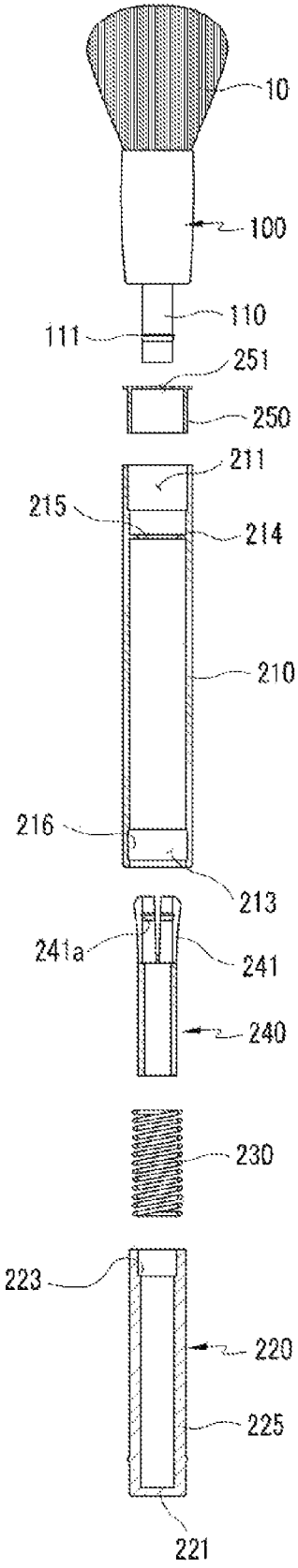
FIG. 4 is a sectional view illustrating the inside of an interchangeable makeup brush according to the present invention.
Figure 5:
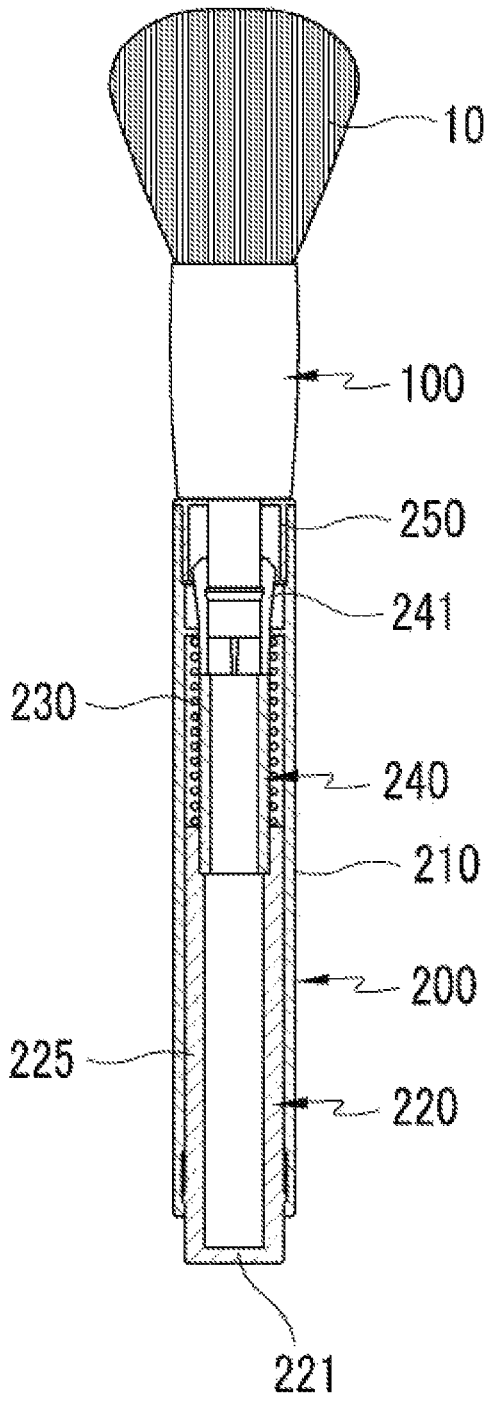
FIGS. 5 and 6 are vertical sectional views illustrating an interchangeable makeup brush according to the present invention.
Figure 6:
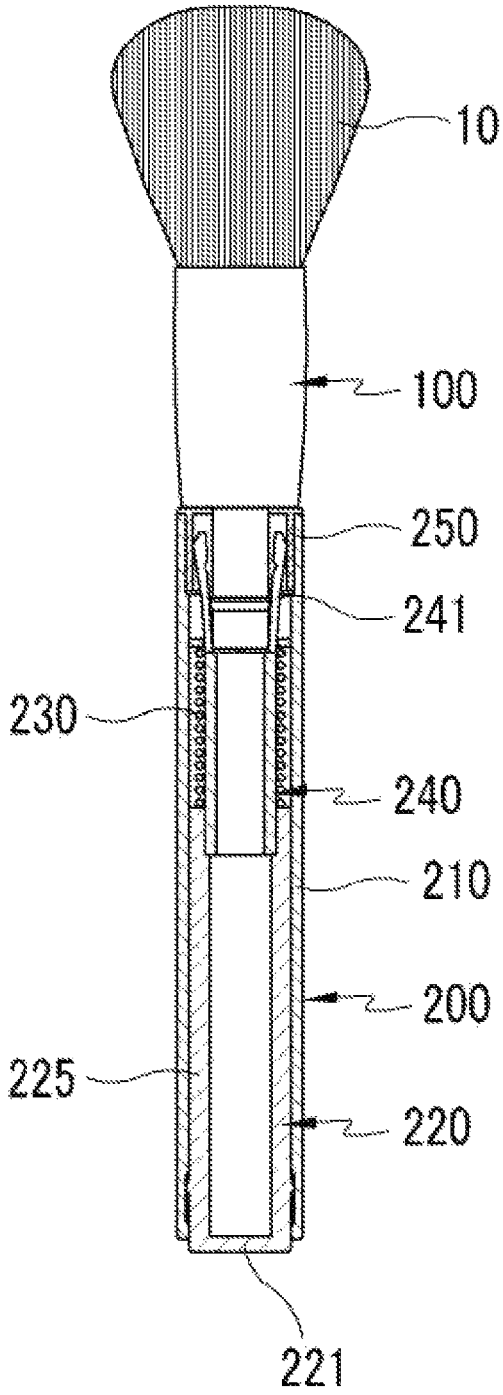

FIG. 1 is a drawing illustrating brush tips for an interchangeable makeup brush according to the present invention, FIG. 2 is a perspective view illustrating an interchangeable makeup brush according to the present invention, FIG. 3 is an exploded perspective view illustrating an interchangeable makeup brush according to the present invention, FIG. 4 is a sectional view illustrating the inside of an interchangeable makeup brush according to the present invention, and FIGS. 5 and 6 are vertical sectional views illustrating an interchangeable makeup brush according to the present invention.

Referring to FIGS. 1 through 6, an interchangeable makeup brush according to the present invention includes a plurality of brush tips 100 that on which a brush 10 is fixed, and a brush rod 200 to which the brush tips 100 are detachably coupled and which a user may grasp by hand, and is configured such that a mounting protruding portion 110 formed at the rear of the brush tips 100 is inserted and coupled in the brush rod 200. The interchangeable makeup brush is configured to enable a user to change an installed brush tip 100 having hairs of a different size and shape and insert another in the brush rod 200 for use.

A catch protrusion 111 is formed on an outer surface of the mounting protruding portion 110 so that the brush tip 100 does not arbitrarily fall out, and may be firmly mounted to the brush rod 200.

The brush rod 200 includes: a housing 210 having a first open portion 211 and a second open portion 213 formed respectively on the upper and lower portion thereof, and a stopper portion 214 having a through-hole 215 along the inner peripheral surface thereof; a push member 220 inserted and coupled to slidably move inside the housing 210, and having a bottom portion that is partially exposed to the outside of the housing 210 through the second open portion 213; a spring 230 inserted inside the housing 210, and having one end thereof supported on the stopper portion 214 and the other end supported on the push member 220 so as to resiliently support the push member 220; a holder 240 inserted and fixed in the top end of the push member 220, and having a finger portion 241 formed cut in the upper portion thereof to selectively clamp (hold) the mounting protruding portion 110 of the brush tip 100; and a cap 250 coupled to the first open portion 211.

For the brush rod 200, the housing 210 is formed in a pipe shape, and a first open portion 211 is formed on an upper portion thereof, and a second open portion 213 is formed on a lower portion thereof. Here, the top and bottom of housing 210 are not distinguished from one another, and the top and bottom may be switched according to the top and bottom position of the brush 10.

A stopper portion 214 is formed on the inner peripheral surface of the housing 210 and has a through-hole 215 along the inner peripheral surface.

The stopper portion 214 also functions to support the spring 230 and functions to close or open the finger portion 241 of the holder 240.

A catching ledge 216 is formed on the lower, inner surface of the housing 210 to restrict the position of the push member 220, and a catch protrusion 225 is formed on the outer peripheral surface of the push member 220 corresponding to the catching ledge 216.

The push member 220 is inserted and coupled to slidably move inside the housing 210, and a pushing portion 221 is configured exposed to the outside of the housing 210 through the second open portion 213. A fixing ledge 223 is formed on the upper portion of the push member 220.

The spring 230 is inserted inside the housing 210, and has one end thereof supported on the stopper portion 214 and the other end supported on the push member 220 so as to perform the function of resiliently supporting the push member 220.

The pressing portion 221 is maintained exposed to the outside of the housing 210 through the second open portion 213 by means of the spring 230.

The holder 240 performs the function of clamping or unclamping the mounting protruding portion 110 of the brush tip 100, is inserted and coupled to slidably move inside the housing 210, and is fixed to the fixing ledge 223 at the bottom of the holder 240.

A finger portion 241 for selectively clamping (holding) the mounting protruding portion 110 is cut and formed at the upper portion of the holder 240.

The finger portion 241 is formed having resilience, so that it converges when it is pressed by the stopper portion 214 and spreads out when not pressed by the stopper portion 214. A catching ledge 241*a* corresponding to the catch protrusion 111 is formed on the inner surface of the finger portion 241.

When the pressing portion 221 of the push member 220 is exposed to the outside of the housing 210 by means of the spring 230, the finger portion 241 of the holder 240 clamps the mounting protruding portion 110 of the brush tip 100 so that the brush tip 100 is mounted to the brush rod 200, and when a user overcomes the resilience of the spring 230 and presses the pressing portion 221 of the push member 220, the finger portion 241 of the holder 240 unclamps the mounting protruding portion 110 of the brush tip 100, and the brush tip 100 is separated from the brush rod 200.

The cap 250 is coupled to the first open portion 211, and an insert hole 251 is formed in the center thereof for the mounting protruding portion 110 to be inserted therein.

The effects of the above-configured interchangeable makeup brush according to the present invention are as follows.

When applying makeup having respectively different functions, different brushes must be selected and used, and as illustrated in FIGS. 1A to 1H, a brush tip 100 is provided on which many types of brushes are mounted. The mounting protruding portions 110 of the brush tips 100 all have the same size.

A user selects a suitable brush for use, and inserts the mounting protruding portion 110 of a brush tip 100 into an insert hole 251 of the cap 250.

Here, the mounting protruding portion 110 is resiliently inserted into the finger portion 241 of the holder 240, and the catch protrusion 111 catches on the catching ledge 241*a* of the finger portion 241 so that it does not disengage, thereby completing the mounting of the brush tip 100.

In order to separate the brush tip 100 to apply makeup having a different function, when the pressing portion 221 of the push member 220 overcomes the resilient force of the spring 230 and moves, the holder 240 is moved. Here, the finger portion 241 that was converged by means of the stopper portion 214 is opened to unclamp the mounting protruding portion 110 of the brush tip 100 and separate the brush tip 100 from the brush rod 200.

The push member 220 and the holder 240 are restored to their original positions by the spring 230, the pressing portion 221 of the push member 220 is exposed to the outside of the housing 210 through the second open portion 213, and the finger portion 241 of the holder 240 is maintained in a closed state by means of the stopper 214.

As described above, the present invention is configured in a structure in which a brush tip may be attached and detached to and from a brush rod, enabling convenient use when applying makeup by selecting and mounting a required brush, and allowing only one brush rod to be provided for economical advantage and ease of portability and storage.

Thus, the rights of the present invention are not limited to the above-described embodiments, and are defined by the scope of the appended claims. It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An interchangeable makeup brush comprising:

a plurality of brush tips (100) fixing a brush (10); and a brush rod (200) having the brush tip (100) detachably coupled thereto, and being grasped by a hand of a user, wherein the brush tip (100) includes a mounting protruding portion (110) formed at a rear thereof which is inserted and coupled in the brush rod (200);

wherein the brush rod (200) includes:

i) a housing (210) having a first open portion (211) and a second open portion (213) respectively formed on a top and bottom thereof, and a stopper portion (214) formed thereon and having a through-hole (215) formed along an inner peripheral surface thereof;

ii) a push member (220) inserted and coupled to be capable of sliding movement within the housing (210), and having a bottom portion thereof partially exposed to an outside of the housing (210) through the second open portion (213);

iii) a spring (230) inserted in the housing (210), and having one end thereof supported on the stopper portion (214) and the other end thereof supported on the push member (220) to resiliently support the push member (220);

iv) a holder (240) having a void and cylindrical shape, and inserted and fixed in a top of the push member (220), and having a finger portion (241) formed cut at an upper portion thereof, the finger portion being configured to selectively clamp (hold) the mounting protruding portion (110) of the brush tip (100); and v) a cap (250) coupled to the first open portion (211);

wherein, when a pressing portion (221) of the push member (220) is exposed to the outside of the housing (210) by the spring (230), the finger portion (241) of the holder (240) clamps the mounting protruding portion (110) of the brush tip (100) to mount the brush tip (100) to the brush rod (200), and when a user overcomes a resilient force of the spring (230) and presses the pressing portion (221) of the push member (220), the finger portion (241) of the holder (240) unclamps the mounting protruding portion (110) of the brush tip (100) to separate the brush tip (100) from the brush rod (200).

2. The interchangeable makeup brush of claim 1, wherein the push member (220) includes a fixing ledge (223) formed on an upper portion thereof, and a lower portion of the holder (240) is fixed on the fixing ledge (223).

3. The interchangeable makeup brush of claim 1, wherein the housing (210) includes a catching ledge (216) formed on a lower, inner surface thereof for restricting a position of the push member (220), and the push member (220) includes a catch protrusion (225) formed on an outer peripheral surface thereof to correspond to the catching ledge (216), the push member (220) and the holder (240) are restored to original positions thereof by the spring (230), the pressing portion (221) of the push member (220) is exposed to an outside of the housing (210) through the second open portion (213), and the finger portion (241) of the holder (240) is maintained in a converged state by the stopper portion (214), and when the spring (230) is inserted into the housing (210), one end thereof is supported on the stopper portion (214), and the other end thereof is supported on the push member (220), to perform a function of resiliently supporting the push member (220).

* * * * *